US008860290B2

(12) United States Patent
Allgaier et al.

(10) Patent No.: US 8,860,290 B2
(45) Date of Patent: Oct. 14, 2014

(54) IGNITER FOR IGNITING A FUEL/AIR MIXTURE IN AN INTERNAL COMBUSTION ENGINE USING A CORONA DISCHARGE

(75) Inventors: Martin Allgaier, Ludwigsburg (DE); Gerd Bräuchle, Hüffenhardt (DE); Thomas Giffels, Stuttgart (DE); Felizitas Heilmann, Gerlingen (DE)

(73) Assignee: Borgwarner Beru Systems GmbH (DE)

( * ) Notice: Subject to any disclaimer, the term of this patent is extended or adjusted under 35 U.S.C. 154(b) by 307 days.

(21) Appl. No.: 13/153,089

(22) Filed: Jun. 3, 2011

(65) Prior Publication Data

US 2012/0139406 A1 Jun. 7, 2012

(30) Foreign Application Priority Data

Jun. 4, 2010 (DE) ..... 10 2010 023 103
Sep. 4, 2010 (DE) ..... 10 2010 044 784

(51) Int. Cl.

*H01T 13/20* (2006.01)
*H01T 13/52* (2006.01)
*H01T 21/02* (2006.01)
*H01T 13/40* (2006.01)
*F02P 23/04* (2006.01)

(52) U.S. Cl.

CPC ..... *H01T 13/52* (2013.01); *F02P 23/045* (2013.01); *H01T 21/02* (2013.01); *H01T 13/40* (2013.01)
USPC ..... 313/137; 313/143

(58) Field of Classification Search

CPC ..... H01T 13/36; H01T 13/50; H01T 13/54; H01T 13/462; H01T 13/467; F02P 23/045
USPC ..... 313/118–145
See application file for complete search history.

(56) References Cited

U.S. PATENT DOCUMENTS

| | | | | |
|---|---|---|---|---|
| 6,060,821 | A * | 5/2000 | Suzuki et al. | 313/141 |
| 7,721,697 | B2 | 5/2010 | Smith et al. | |
| 2004/0129241 | A1 | 7/2004 | Freen | |
| 2007/0188063 | A1 * | 8/2007 | Lykowski | 313/137 |
| 2009/0031988 | A1 | 2/2009 | Shiraishi et al. | |
| 2009/0033194 | A1 | 2/2009 | Jaffrezic et al. | |
| 2010/0212620 | A1 | 8/2010 | Shimizu | |

FOREIGN PATENT DOCUMENTS

WO 2010011838 A1 1/2010

* cited by examiner

*Primary Examiner* — Andrew Coughlin
(74) *Attorney, Agent, or Firm* — Orum & Roth, LLC; Keith H. Orum

(57) ABSTRACT

An igniter for igniting a fuel/air mixture using a corona discharge, generated by a high-frequency electric high voltage, in an internal combustion engine having one or more combustion chambers delimited by walls at ground potential, comprising an ignition electrode, which traverses in an electrically insulated manner one of the walls delimiting the particular combustion chamber and constitutes in cooperation with the walls of the combustion chamber, that are at ground potential, an electrical capacitance. Comprising a metallic or metallized outer member and an elongate passage extending through the outer member, through which extends the ignition electrode, and comprising an insulator which encloses the ignition electrode and insulates it electrically from the outer member, wherein the ignition electrode, the insulator, and the passage have a common longitudinal direction. The insulator is composed of a plurality of layers extending in the longitudinal direction, or is subdivided into a plurality of such layers.

31 Claims, 8 Drawing Sheets

Figure 1:
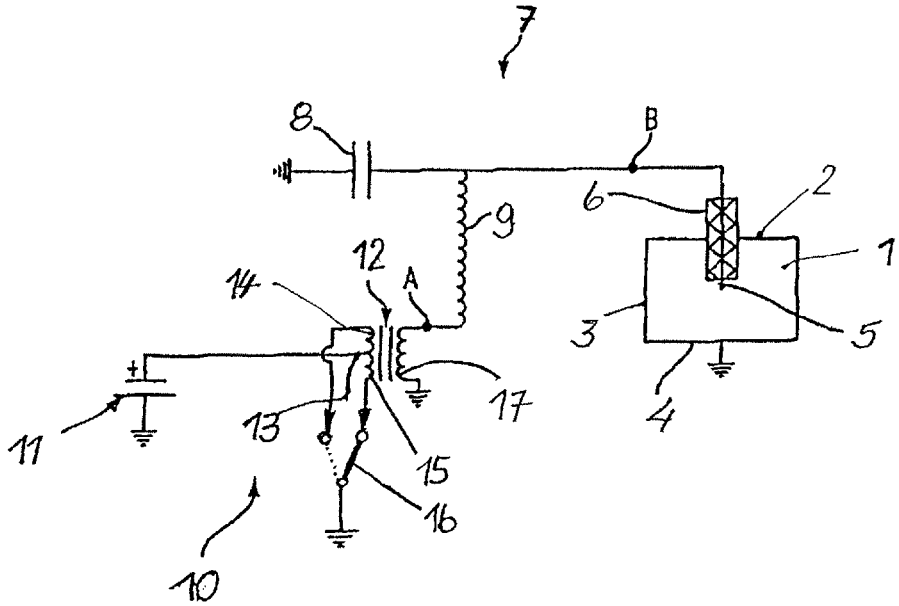

6
5
35
36
34
31
33
6d
6c
6b
6a

IGNITER FOR IGNITING A FUEL/AIR MIXTURE IN AN INTERNAL COMBUSTION ENGINE USING A CORONA DISCHARGE

The invention is directed to an igniter having the features disclosed in WO 2004/063560 A1.

Document WO 2010/011838 A1 discloses how a fuel/air mixture can be ignited in a combustion chamber of an internal combustion engine by a corona discharge created in the combustion chamber. For this purpose an ignition electrode traverses one of the walls, that are at ground potential, of the combustion chamber in an electrically insulated manner and extends into the combustion chamber, preferably opposite a reciprocating piston provided in the combustion chamber. The ignition electrode constitutes a capacitance in cooperation with the walls of the combustion chamber that are at ground potential and function as a counterelectrode. The combustion chamber and the contents thereof act as a dielectric. Air or a fuel/air mixture or exhaust gas is located therein, depending on which stroke the piston is engaged in.

The capacitance is a component of an electric oscillating circuit which is excited using a high-frequency voltage which is created, for example, using a transformer having a center tap. The transformer interacts with a switching device which applies a specifiable DC voltage to the two primary windings, in alternation, of the transformer connected by the center tap. The secondary winding of the transformer supplies a series oscillating circuit comprising the capacitance formed by the ignition electrode and the walls of the combustion chamber. The frequency of the alternating voltage which excites the oscillating circuit and is delivered by the transformer is controlled such that it is as close as possible to the resonance frequency of the oscillating circuit. The result is a high voltage at the ignition electrode which extends into the combustion chamber in which the ignition electrode is disposed. The resonance frequency is typically between 30 kilohertz and 3 megahertz, and the alternating voltage reaches values at the ignition electrode of 50 kV to 500 kV, for example.

A corona discharge can therefore be created in the combustion chamber. The corona discharge should not break down into an arc discharge or a spark discharge. Measures are therefore implemented to ensure that the voltage between the ignition electrode and the combustion chamber walls, which are at ground potential, remains below the voltage required for a complete breakdown.

The space that is available in an internal combustion engine for enabling the ignition electrode, and the insulator enclosing same, traversing a combustion chamber wall, in particular traversing the cylinder head of a piston engine, is limited, especially in modern engines for passenger vehicles, in which case a threaded hole of M10 to maximum M14 is typically provided for screwing in a spark plug, and therefore an outer diameter of no more than approximately 10 mm is available for the insulator of an igniter according to the invention. Moreover, there are demands to further reduce the size of the threaded bores in the cylinder head. Considering the high requirements placed primarily on the insulation capacity of the insulator—high voltages in the range of 50 kV to 100 kV at frequencies in the range of 30 kHz to 3 MHz, combined with small passage openings in the combustion chamber walls, high and fluctuating pressures and temperatures in the combustion chamber, and attacks by the combustion chamber atmosphere—engineers involved in the development of a igniter according to the invention for internal combustion engines face considerable challenges.

The problem addressed by the present invention is that of creating an igniter of the initially stated type, which meets these challenges better than ever before.

This problem is solved by an igniter having the features indicated in claim 1. Advantageous developments of the invention are the subject matter of the dependent claims.

The igniter according to the invention, in order to ignite a fuel/air mixture using a corona discharge, which is generated by a high-frequency electric high voltage, in an internal combustion engine having one or more combustion chambers delimited by walls that are at ground potential comprises an ignition electrode which traverses one of the walls delimiting the particular combustion chamber in an electrically insulated manner and constitutes an electrical capacitance in cooperation with the combustion chamber walls that are at ground potential. Furthermore, the igniter comprises a metallic or metallized outer member having an elongate passage extending through the outer member, through which the ignition electrode is guided. The ignition electrode is electrically insulated with respect to the outer member using an insulator, which encloses the ignition electrode, so well that the high-frequency high voltage can always be built up and sustained between the ignition electrode and the outer member for a period of time required to generate an ignitable corona discharge. The ignition electrode, the insulator, and the passage which is provided in the outer member of the igniter and accommodates the insulator with the ignition electrode have a common longitudinal direction. The insulator is composed of a plurality of layers extending in the longitudinal direction, wherein adjacent layers preferably differ in terms of at least one electrical property.

The layered design of the insulator makes it possible to optimize the insulation capacity thereof, to prevent high electric field strengths in and on the insulator, and to shape the distribution of the electric field in the insulator such that peaks of the electric field strength—which appear axially, e.g. by way of angular transitions, as well as radially, e.g. by the reduced diameter of the ignition electrode relative to the inner diameter of the outer member—are reduced or prevented. The outer member can be a wall of the combustion chamber, in particular the cylinder head of a piston engine. The outer member can also be a separate metallic housing which can be provided with an outer thread, for example, thereby enabling it to be screwed into a threaded bore in the cylinder head, similar to a spark plug. Alternatively, the housing can be conductively coated on the inner side thereof. As an alternative or in addition thereto, the insulator can be conductively coated on the outer jacket surface thereof.

The insulator of the igniter according to the invention should in particular comprise layers that differ in terms of the dielectric properties thereof, i.e. primarily in terms of the permittivity thereof. This makes it possible for a person skilled in the art to reduce the maximum electric field strength in the insulator between the ignition electrode and the enclosing metallic or conductively coated outer member, under the given boundary conditions. It is particularly preferred, that the layers and the material thereof are so selected that from layer to layer the permittivity in the directions transverse to the longitudinal direction of the ignition electrode decreases with increasing distance from the ignition electrode. In the case of a homogeneous insulator, the field lines of the electric field would become more heavily concentrated—graphically speaking—in the boundary surface between the ignition electrode and the insulator than in the boundary surface between the insulator and the outer member. The high concentration of the electric field in the boundary surface between the ignition electrode and the insulator can be deliberately reduced by installing an insulating material there having a higher permittivity than in the outer region of the insulator. As a result, the insulation capacity of the insulator can be increased and/or the diameter of the ignition electrode and, therewith, the outer diameter of the insulator and the diameter of the outer member can be reduced, thereby fulfilling the aforementioned demand for miniaturization.

The electrically insulating layers are preferably composed of a ceramic material, in particular of an oxide ceramic material. Potential ceramic materials for the electrically insulating layers include, in particular, aluminum oxide (the relative permittivity $\epsilon$ of which is between 8 and 10), zirconium oxide (the relative permittivity $\epsilon$ of which has a value of approximately 20), and silicon dioxide (the relative permittivity $\epsilon$ of which is in the range of 2 to 4). To homogenize the electric field in the insulator, said insulator can comprise e.g. three layers of different ceramic materials, the innermost layer of which is composed of zirconium oxide, the middle layer of which is composed of aluminum oxide, and the outer layer of which is composed of silicon dioxide. The field distribution can be further optimized by varying the layer thicknesses and/or by changing the composition of the layers to adjust other values of the permittivity. For this purpose, ceramic layers can be manufactured, for instance, which contain mixtures of the above stated oxides in different mixing ratios. In a development of the invention, the above stated oxides can also be mixed with other mineral or ceramic materials which are suitable for insulation purposes, such as mixed oxides, carbides, or nitrides.

According to an advantageous development of the invention, one or more electrically conductive intermediate layers are embedded in the insulator. In particular, an electrically conductive intermediate layer is disposed between at least two electrically insulating layers having different permittivity. Since they do not have insulating property, they should be thinner, preferably much thinner, than the electrically insulating layers. Conductive intermediate layers having a thickness of 5 μm to 100 μm are suitable. A metal film is suitable for use as the conductive intermediate layers. Instead of a metal film, a thin intermediate layer composed of a conductive ceramic can also be provided between two electrically insulating layers. Particularly thin conductive intermediate layers are obtained by depositing a metal onto a ceramic layer, e.g. using a PVD (physical vapor deposition) method.

A conductive intermediate layer influences the distribution of the electric field in the insulator by drawing a portion of the field lines into the ends of the conductive intermediate layer. Preferably the ends of the conductive intermediate layer are positioned in the insulator such that they bind a part of the electric field where the geometric design of the igniter promotes the formation of peaks of the electric field strength, and that is the case in particular where edges of the outer member of the igniter meets the insulator, which is always the case when the insulator extends beyond at least one end of the outer member, which is preferred. The electrically conductive intermediate layer reduces or prevents electric field strength peaks particularly effectively when it terminates between the end of the outer member of the igniter and the adjacent end of the insulator.

Preferably at least two electrically conductive intermediate layers are provided, of which the intermediate layer located closer to the ignition electrode preferably terminates closer to the end of the insulator than the intermediate layer located further away from the ignition electrode. This is particularly favorable for preventing field strength peaks in the region between the ends of the insulator and the ends of the outer member that encloses the insulator.

The electrically conductive intermediate layers should not emerge from the insulator anywhere, under any circumstances. Instead, they are embedded entirely in the insulator.

Advantageously, the layers forming the insulator, including the electrically conductive intermediate layers that may be embedded therein, are disposed coaxially to the ignition electrode. The layers preferably have circular cross sections, as is also preferably the case with the ignition electrode. Basically, however, other cross-sectional shapes are also possible, e.g. a square having rounded corners or a polygon having rounded corners, e.g. a regular hexagon having rounded corners.

The invention is explained in greater detail below with reference to the attached schematic drawings.

Figure 3:
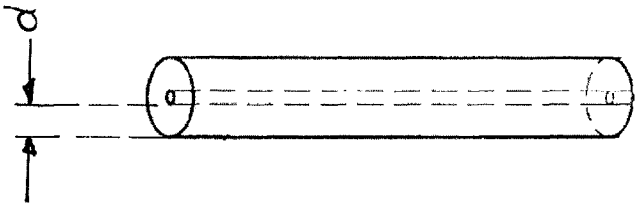
Figure 2:
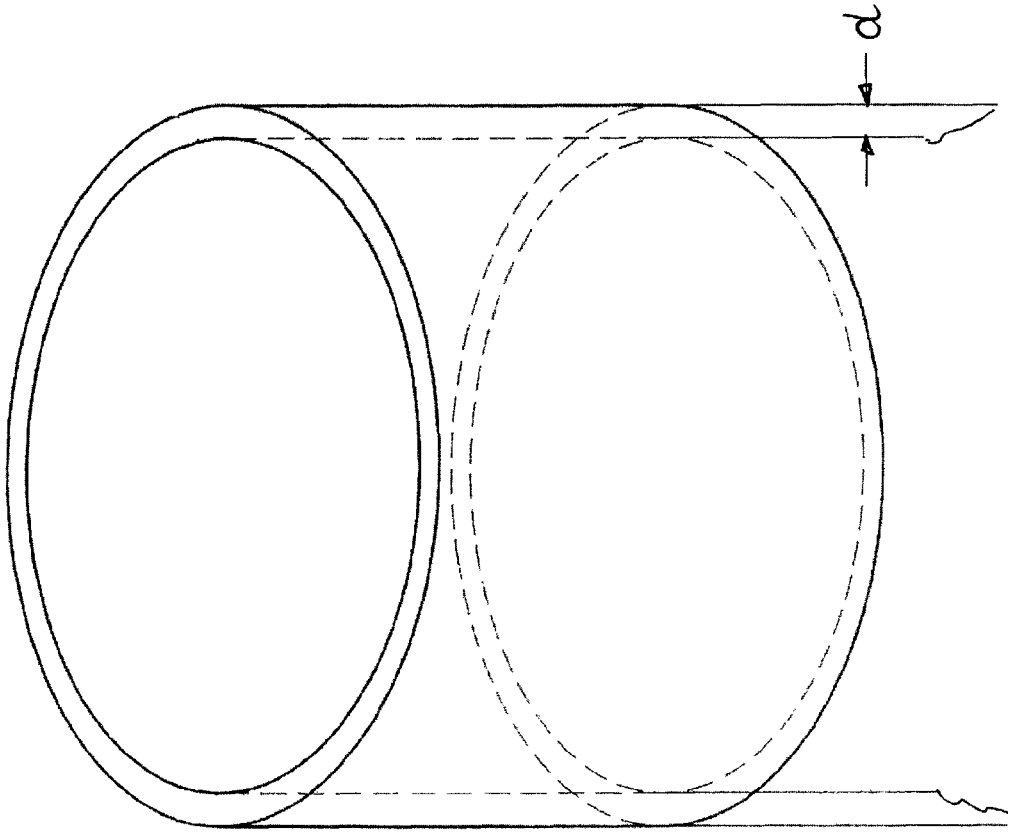
Figure 5:
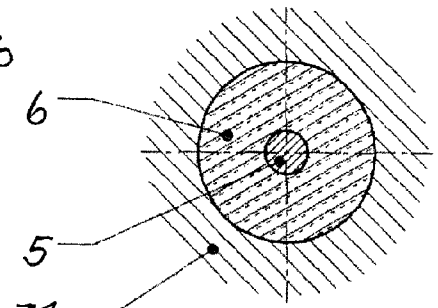
Figure 4:
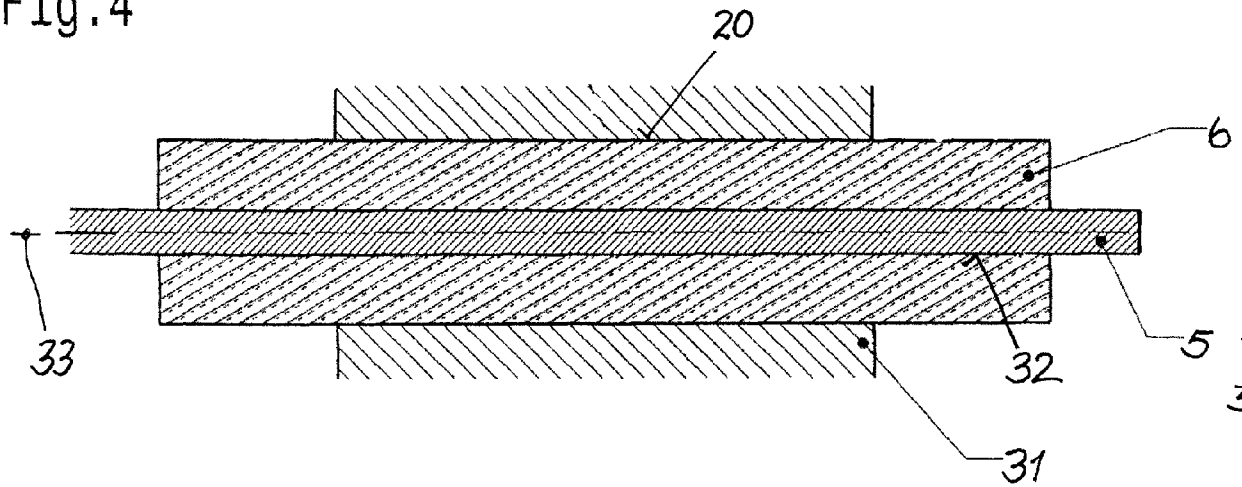
Figures 6, 7, 8, 9:
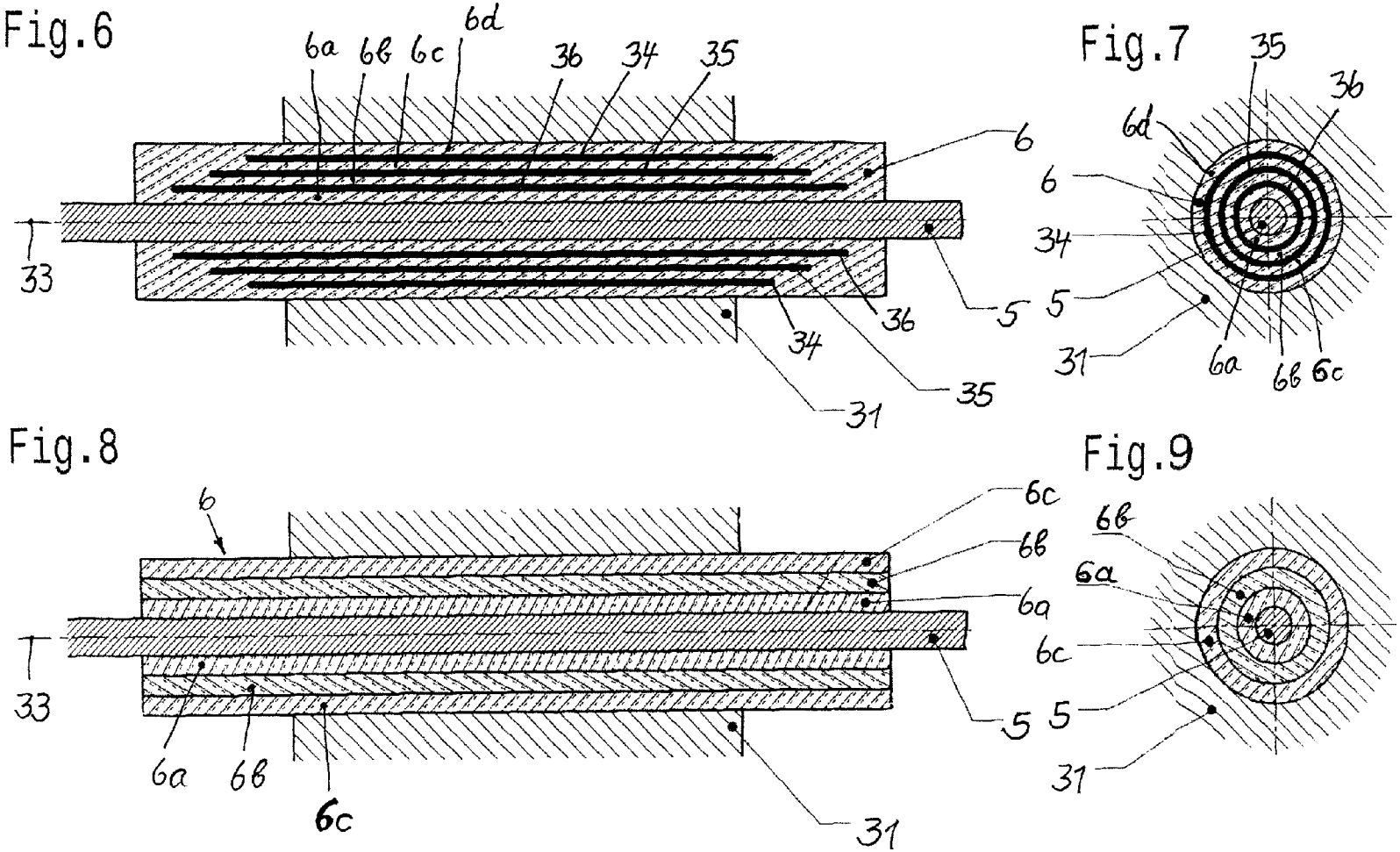
Figure 11:
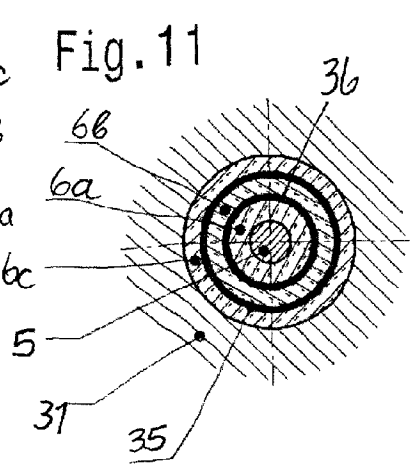
Figure 13:
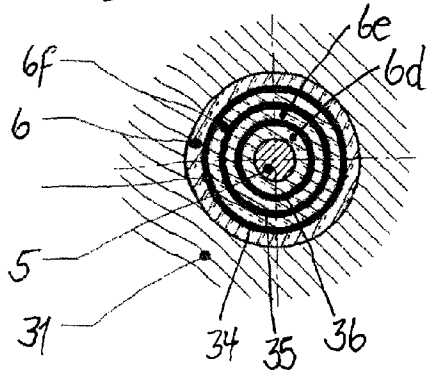
Figure 10:
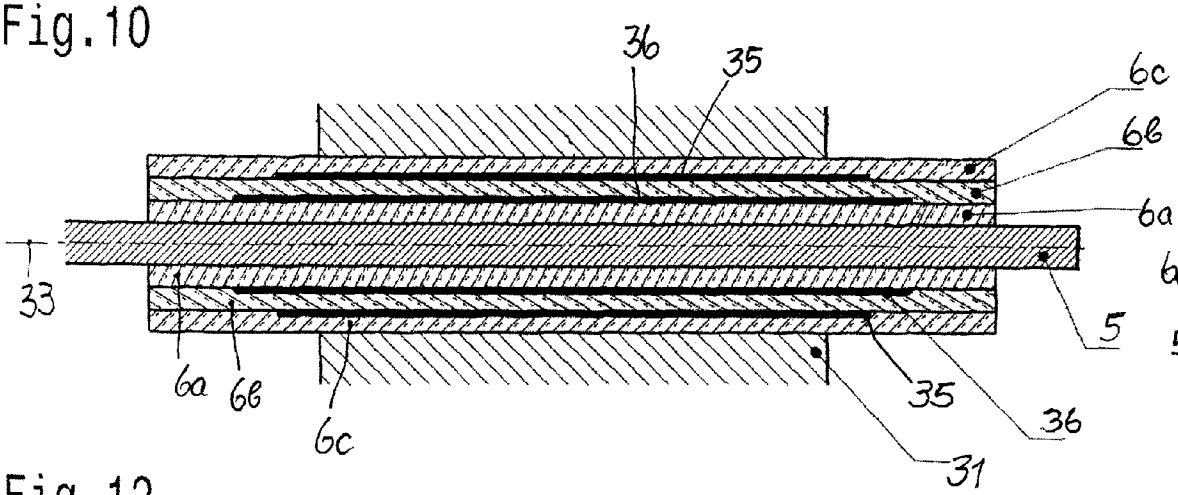
Figure 12:
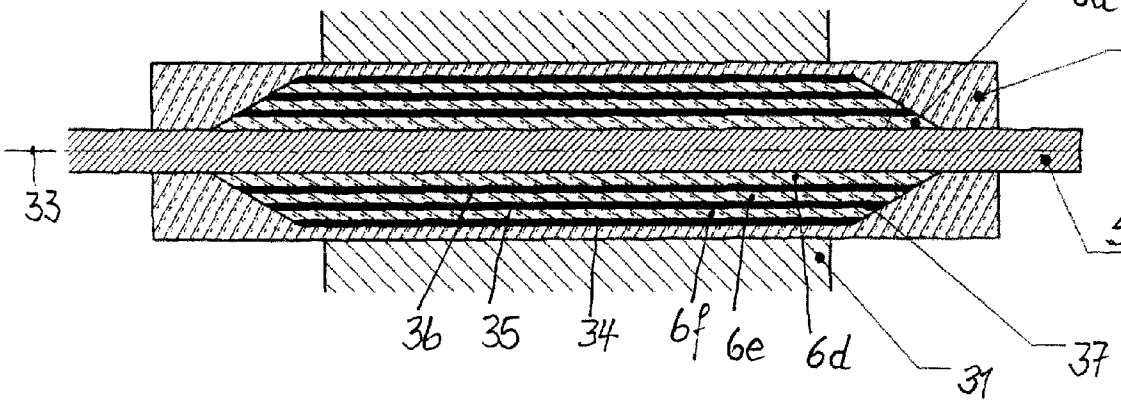
Figure 14:
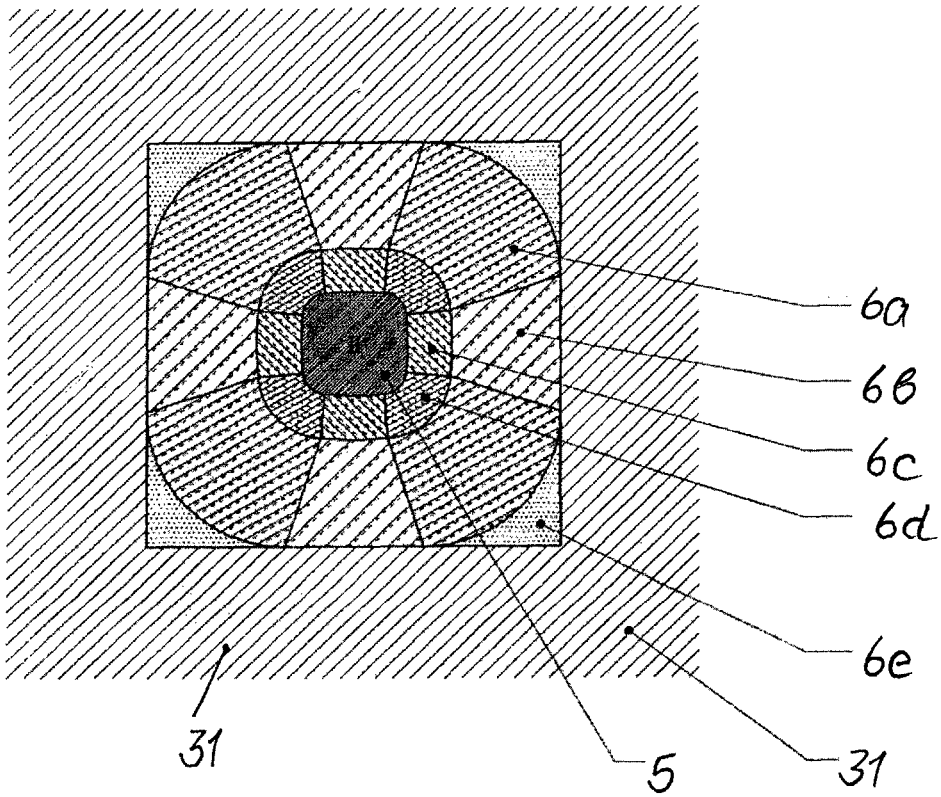
Figure 16:
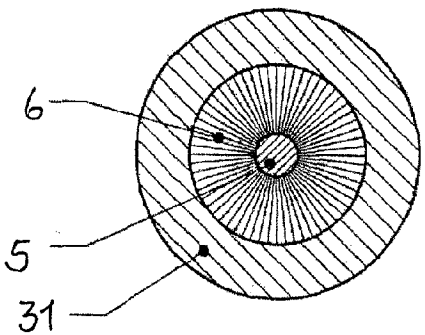
Figure 15:
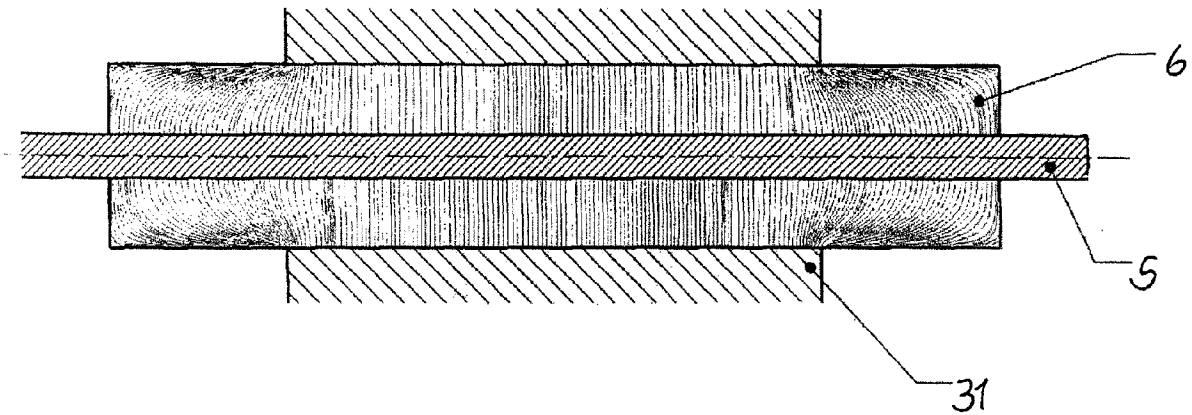
Figure 18:
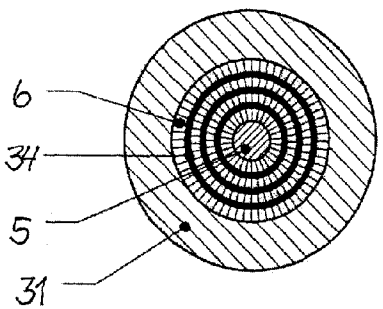
Figure 20:
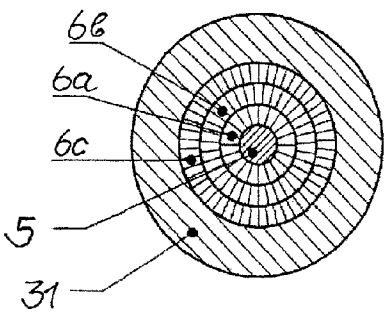
Figure 17:
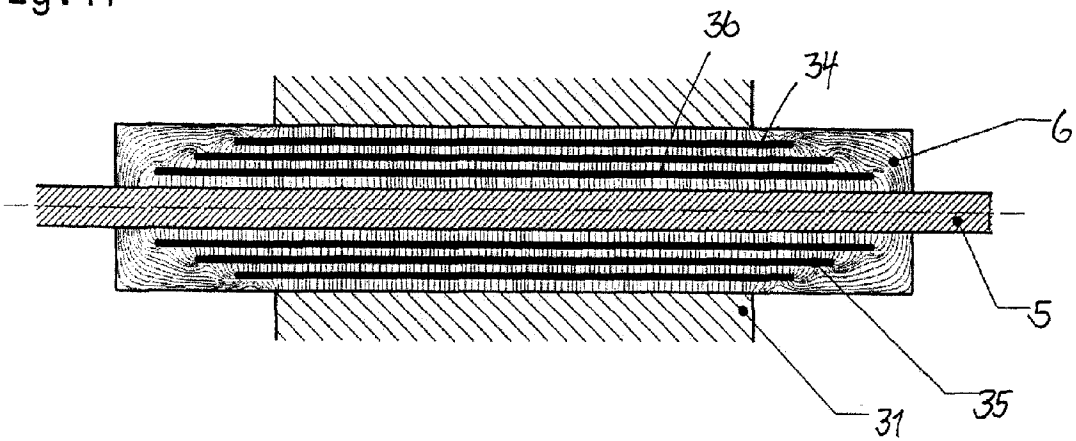
Figure 19:
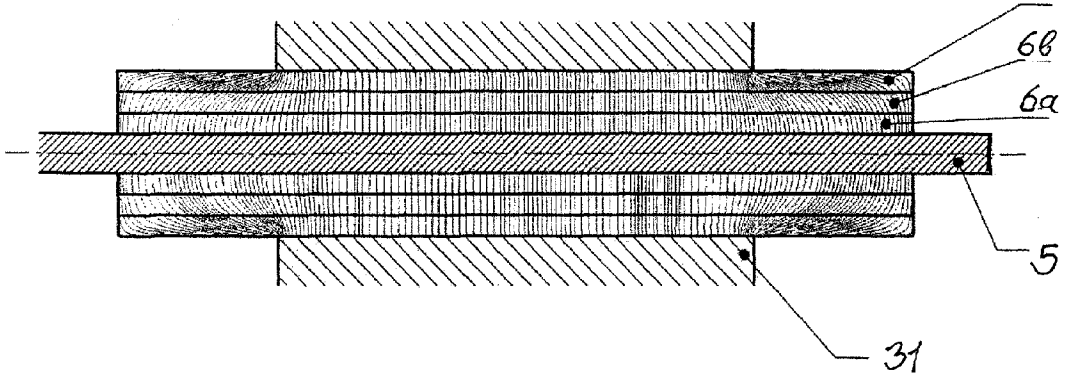

FIG. 1 shows a schematic depiction of the design of an ignition system for a vehicle engine, FIG. 2 is a perspective view of an insulator designed as a hollow cylinder, FIG. 3 is a perspective view of an insulator designed as a hollow cylinder, the outer diameter of which was reduced compared to the insulator shown in FIG. 1, although the wall thickness was left untouched, FIG. 4 shows a longitudinal cross section of a homogeneous insulator through which extends an ignition electrode, the insulator being inserted into a schematically depicted outer member, FIG. 5 shows the arrangement depicted in FIG. 4, in a cross section, FIG. 6 shows a longitudinal cross section of an insulator in an arrangement depicted in FIG. 4, but with electrically conductive intermediate layers embedded therein, in the shape of sleeves, FIG. 7 shows the arrangement depicted in FIG. 6, in a cross section, FIG. 8 shows a longitudinal cross section of an insulator in an arrangement depicted in FIG. 4, but in a three-layered design, without electrically conductive intermediate layers, FIG. 9 shows the arrangement depicted in FIG. 8, in a cross section, FIG. 10 shows a longitudinal cross section of a variant of the arrangement depicted in FIG. 8, comprising conductive intermediate layers, FIG. 11 shows the arrangement depicted in FIG. 10, in a cross section, FIG. 12 shows a longitudinal cross section of an insulator in an arrangement depicted in FIG. 4, but with an insert which comprises an electrically insulating material, interrupted by conductive intermediate layers, FIG. 13 shows the arrangement depicted in FIG. 12, in a cross section, FIG. 14 shows a cross section of an arrangement of an ignition electrode, an insulator, and an outer member, wherein the insulator has a multi-layered design, and the layers of which are disposed in a partial star-shaped manner around the ignition electrode, FIG. 15 shows the arrangement depicted in FIG. 4, wherein the distribution of the electric field in the insulator is depicted, FIG. 16 shows the arrangement depicted in FIG. 15, in a cross section, FIG. 17 shows the arrangement depicted in FIG. 6, wherein the distribution of the electric field in the insulator is depicted, FIG. 18 shows the arrangement depicted in FIG. 17, in a cross section, FIG. 19 shows the arrangement depicted in FIG. 8, wherein the distribution of the electric field lines in the insulator is depicted, and FIG. 20 shows the cross section of the arrangement depicted in FIG. 19.

FIG. 1 is a schematic depiction of an ignition system disclosed in WO 2010/011838 A1. FIG. 1 shows a combustion chamber 1 which is delimited by walls 2, 3, and 4 that are at ground potential. An ignition electrode 5 which is enclosed by an insulator 6 along a portion of the length thereof extends into combustion chamber 1 from above, and extends through upper wall 2 into combustion chamber 1 in an electrically insulated manner by way of said insulator 6. Ignition electrode 5 and walls 2 to 4 of combustion chamber 1 are part of a series oscillating circuit 7 which also includes a capacitor 8 and an inductor 9. Of course, series oscillating circuit 7 can also comprise further inductances and/or capacitances, and other components that are known to a person skilled in the art as possible components of series oscillating circuits.

A high-frequency generator 10 is provided, for instance, for excitation of oscillating circuit 7, and comprises a DC voltage source 11 and a transformer 12 having a center tap 13 on the primary side thereof, thereby enabling two primary windings 14 and 15 to meet at center tap 13. Using a high-frequency switch 16, the ends of primary windings 14 and 15 opposite center tap 13 are connected to ground in alternation. The switching rate of high-frequency switch 16 determines the frequency with which series oscillating circuit 7 is excited, and can be changed. Secondary winding 17 of transformer 12 supplies series oscillating circuit 7 at point A. High-frequency switch 16 is controlled using a not-shown control loop such that the oscillating circuit is excited with the resonant frequency thereof. The voltage between the tip of ignition electrode 5 and walls 2 to 4 that are at ground potential is therefore at a maximum.

FIG. 2 shows an example of a hollow cylindrical insulator through which a high voltage-conducting electrode can extend. The insulator has a wall thickness d. FIG. 3 shows a variant of the insulator depicted in FIG. 2. In FIG. 3, the outer diameter of the insulator was reduced without changing the wall thickness d. It is clear that the reduction in size has resulted in a considerable reduction in the ratio between the size of the inner wall surface and the size of the outer wall surface of the insulator. As a result, given the same voltage between the inner side of the insulator and the outer side of the insulator, the intensity of the electric field becomes substantially greater on the inner side of the insulator than on the outer side of the insulator. This poses a hindrance if the objective is to reduce the size of an igniter for a high-frequency ignition of internal combustion engines.

FIGS. 4 and 5 show a metallic outer member 31 comprising a cylindrical passage 20 into which a cylindrical insulator 6 has been inserted. Insulator 6 comprises a cylindrical passage 32 into which an ignition electrode 5 has been inserted and extends through insulator 6. Passage 20 in outer member 31, insulator 6, and ignition electrode 5 have a common longitudinal axis 33. Ignition electrode 5 is inserted into insulator 6 such that passage 32 is sealed by insulator 6. In a similar manner, insulator 6 is inserted into outer member 31 such that passage 20 is sealed.

Outer member 31 can be a combustion chamber wall of an internal combustion engine, in particular a cylinder head 2. However, outer member 31 can also be a separate housing which accommodates insulator 6 through which ignition electrode 5 extends. In that particular case, outer member 31 would be equipped with an outer thread for screwing into a bore in a combustion chamber wall, in particular into a bore in a cylinder head.

The representations shown in FIGS. 4 to 20 are used merely to explain the principle of the invention, and so the depiction of details such as thread, outer contour of the outer member, stops, seals, and the like was omitted.

Insulator 6 shown in FIGS. 4 and 5 is homogeneous in design. FIGS. 4 and 5 therefore do not constitute the present invention, but rather are used to explain the invention in comparison with the other figures.

FIGS. 6 and 7 show a first embodiment of the invention. It differs from the arrangement shown in FIGS. 4 and 5 in that three electrically conductive intermediate layers 34, 35, and 36 disposed coaxially to ignition electrode 5 are embedded in insulator 6 and subdivide insulator 6 into four insulating layers 6*a*, 6*b*, 6*c*, and 6*d* which extend beyond the length of outer member 31 and finally unite outside of outer member 31. Intermediate layers 34-36 have the shape of a sleeve. They extend through outer member 31 and each terminate in the region between an end of outer member 31 and the adjacent end of insulator 6. The ends of sleeve-shaped intermediate layers 34, 35, and 36 are offset relative to one another such that the ends of inner intermediate layer 36 extend beyond the ends of middle intermediate layer 35, and the ends of middle intermediate layer 35 extend beyond the ends of outer conductive intermediate layer 34. The ends of said intermediate layers 34 to 36 attract the electric field in the direction of particular end of layers 34, 35, and 36, as shown in FIG. 17. Since the distance between electrically conductive layers 34, 35, and 36 on the one hand and ignition electrode 5 or outer member 31 is smaller than the distance between ignition electrode 5 and outer member 31, the voltage between ignition electrode 5 and electrically conductive intermediate layers 34 to 36 is less than the voltage between ignition electrode 5 and outer member 31. A field peak at the end of conductive intermediate layers 34, 35, and 36 therefore occurs at a lower voltage than in the case of an insulator 6 without embedded conductive intermediate layers 34 to 36. As the number of conductive intermediate layers 34 to 36 increases, the ends of the electric field become less pronounced, and since the ends of electrically conductive intermediate layers 34, 35, and 36 are in different locations, the field peak between the ends of outer member 31 and insulator 6 becomes less pronounced and is diminished.

The embodiment shown in FIGS. 8 and 9 differs from the arrangement depicted in FIGS. 4 and 5 in that insulator 6 comprises three layers, i.e. three insulating, coaxially disposed layers 6*a*, 6*b*, and 6*c* which have different dielectric properties and thereby influence the electric field strength. Without said layered design, i.e. in an arrangement of the type depicted in FIG. 4, field peaks would occur primarily at the boundary between ignition electrode 5 and insulator 6. The field peaks are reduced by the layered design if the innermost insulator layer has a field-reducing permittivity, i.e. if the permittivity of inner layer 6*a* is greater than that of middle layer 6*b* and outer layer 6*c*, wherein middle layer 6*b* preferably has a greater permittivity than outer layer 6*c*. Due to the better permeability for the electric field, which results from the higher permittivity, the electric field is displaced in insulator 6—which is preferably made of ceramic materials—in the direction toward outer member 31, see FIG. 19, which depicts the field strength distribution for the arrangement shown in FIG. 8. The field strength and, therefore, the voltage present at the inner, smaller surface of insulator 6 diminishes. The resulting relieving of stress on the insulating materials can be adjusted by way of the multi-layered design such that the risk of overloading insulator 6, with the consequence of voltage breakdowns, is eliminated.

FIGS. 10 and 11 show a combination of the two embodiments of the invention depicted in FIGS. 6 to 9. In this case, insulating layers 6*a*, 6*b* and 6*c*, with their different permittivity selected for a radial field strength shift, are combined with two sleeve-shaped, electrically conductive intermediate layers 35 and 36 disposed between electrically insulating layers 6*a* and 6*b*, and 6*b* and 6*c*, and promote a less pronounced, ameliorated field distribution in the axial direction. The shape, number, and/or position of different layers 6*a*, 6*b*, 6*c* and 35 and 36 can be varied for the purpose of optimizing insulator 6.

The embodiment shown in FIGS. 12 and 13 differs from the arrangement depicted in FIGS. 4 and 5 in that a coaxial insert 37 was inserted into insulator 6, which comprises three concentric insulator layers 6*d*, 6*e* and 6*f* which alternate with three coaxial, electrically conductive intermediate layers 34, 35 and 36. Insulating layers 6*d*, 6*e* and 6*f* are preferably composed of a material other than that of the body of insulator 6 enclosing insert 37, and electrically conductive intermediate layers 34, 35, 36 are arranged as shown previously in FIG. 6. The insulating material of layers 6*d*, 6*e*, and 6*f* preferably has a greater permittivity than the body of insulator 6 enclosing insert 37, which can also be selected such that it protects insert 37 which it encloses, e.g. it repels contamination, is impact-resistant, and/or abrasion-resistant. The permittivity should diminish from layer 6*d* toward layer 6*f*.

The embodiment shown in FIG. 14 differs from the other embodiments in that the multi-layered design of insulator 6 selected there is not invariant with respect to arbitrary rotations about the longitudinal axis of the arrangement. Multi-layered insulator 6 has a square cross section and encloses an electrode 6 which has a square cross section and rounded corners.

LIST OF REFERENCE NUMERALS

1. Combustion chamber
2. Wall
3. Wall
4. Wall
5. Ignition electrode
6. Insulator
6*a*. Layer
6*b*. Layer
6*c*. Layer
6*d*. Layer
6*e*. Layer
6*f*. Layer
7. Oscillating circuit
8. Capacitor
9. Inductor
10. High-frequency generator
11. DC voltage source
12. Transformer
13. Center tap
14. Primary winding
15. Primary winding
16. High-frequency switch
17. Secondary winding
31. Outer member
32. Passage
33. Longitudinal axis
34. Electrically conductive layer
35. Electrically conductive layer
36. Electrically conductive layer
37. Insert

The invention claimed is:

1. An igniter for igniting a fuel/air mixture using a corona discharge, which is generated by a high-frequency electric high voltage, in an internal combustion engine having one or more combustion chambers delimited by walls that are at ground potential, comprising an ignition electrode, which traverses in an electrically insulated manner one of the walls delimiting the particular combustion chamber and constitutes in cooperation with the walls of the combustion chamber, that are at ground potential, an electrical capacitance, comprising a metallic or metallized outer member and an elongate passage extending through the outer member, through which extends the ignition electrode, and comprising an insulator which encloses the ignition electrode and insulates it electrically from the outer member, wherein the ignition electrode, the insulator, and the passage have a common longitudinal direction, wherein the insulator is composed of a plurality of layers extending in the longitudinal direction, or is subdivided into a plurality of such layers, and wherein at least one electrically conductive intermediate layer is embedded entirely in the insulator, such that at least between two electrically insulating layers is disposed one electrically conductive intermediate layer.

2. The igniter according to claim 1, wherein adjacent layers differ in terms of at least one electrical property.

3. The igniter according to claim 1, wherein the insulator has insulating layers which differ in terms of their permittivity.

4. The igniter according to claim 3, wherein the permittivity transverse to the longitudinal direction diminishes as the distance from the ignition electrode increases.

5. The igniter according to claim 3, wherein the permittivity of an insulating layer decreases within the layer with increasing distance away from the ignition electrode.

6. The igniter according to claim 3, wherein the permittivity transverse to the longitudinal direction diminishes from layer to layer as the distance from the ignition electrode increases.

7. The igniter according to claim 1, wherein the electrically insulating layers are composed of ceramic material.

8. The igniter according to claim 7, wherein the ceramic materials for the electrically insulating layers are aluminium oxide and/or zirconium oxide and/or silicon oxide and/or mixtures of these oxides with each other and/or with other ceramic materials.

9. The igniter according to claim 1, wherein the at least one electrically conductive intermediate layer is thinner, preferably much thinner, than the electrically insulating layers.

10. The igniter according to claim 9, wherein the at least one electrically conductive intermediate layer is between 5 μm and 100 μm thick.

11. The igniter according to claim 9, wherein the at least one electrically conductive intermediate layer is deposited onto an insulating layer using a PVD method.

12. The igniter according to claim 1, wherein the insulator extends beyond at least one end of the outer member, and that the at least one electrically conductive intermediate layer terminates between the end of the outer member and the adjacent end of the insulator.

13. The igniter according to claim 12, wherein at least two electrically conductive intermediate layers are provided, of which the conductive intermediate layer located closer to the ignition electrode terminates closer to the end of the insulator than the conductive intermediate layer located further away from the ignition electrode, none of the electrically conductive intermediate layers emerging from the insulator at any point.

14. The igniter according to claim 1, wherein at least some of the layers enclose the ignition electrode in the manner of a sleeve.

15. The igniter according to claim 1, wherein the layers are disposed coaxially to the ignition electrode.

16. The igniter according to claim 1, wherein the layers have annular cross sections.

17. The igniter according to claim 1, wherein the outer member is a component of a combustion chamber wall.

18. The igniter according to claim 1, wherein the outer member comprises an outer thread for screwing it into a bore in a combustion chamber wall.

19. The igniter according to claim 1, wherein the insulator has layers which differ in terms of their dielectric properties.

20. An igniter for igniting a fuel/air mixture using a corona discharge, which is generated by a high-frequency electric high voltage, in an internal combustion engine having one or more combustion chambers delimited by walls that are at ground potential, comprising an ignition electrode, which traverses in an electrically insulated manner one of the walls delimiting the particular combustion chamber and constitutes in cooperation with the walls of the combustion chamber, that are at ground potential, an electrical capacitance, comprising a metallic or metallized outer member and an elongate passage extending through the outer member, through which extends the ignition electrode, and comprising an insulator which encloses the ignition electrode and insulates it electrically from the outer member, wherein the ignition electrode, the insulator, and the passage have a common longitudinal direction, wherein the insulator is composed only of a plurality of adjacent insulating layers extending in the longitudinal direction, which differ in terms of their dielectric properties, or is subdivided into a plurality of such adjacent insulating layers, which differ in terms of their dielectric properties.

21. The igniter according to claim 20, wherein the insulator has layers which differ in terms of their permittivity.

22. The igniter according to claim 21, wherein the permittivity transverse to the longitudinal direction diminishes as the distance from the ignition electrode increases.

23. The igniter according to claim 21, wherein the permittivity of an insulating layer decreases within the layer with increasing distance away from the ignition electrode.

24. The igniter according to claim 20, wherein the electrically insulating layers are composed of ceramic material.

25. The igniter according to claim 24, wherein the ceramic materials for the electrically insulating layers are aluminium oxide and/or zirconium oxide and/or silicon oxide and/or mixtures of these oxides with each other and/or with other ceramic materials.

26. The igniter according to claim 20, wherein at least some of the layers enclose the ignition electrode in the manner of a sleeve.

27. The igniter according to claim 20, wherein the layers are disposed coaxially to the ignition electrode.

28. The igniter according to claim 20, wherein the layers have annular cross sections.

29. The igniter according to claim 20, wherein the outer member is a component of a combustion chamber wall.

30. The igniter according to claim 20, wherein the outer member comprises an outer thread for screwing it into a bore in a combustion chamber wall.

31. The igniter according to claim 20, wherein the permittivity transverse to the longitudinal direction diminishes from layer to layer as the distance from the ignition electrode increases.

* * * * *